United States Patent [19]

Ferri

[11] Patent Number: 4,864,759

[45] Date of Patent: Sep. 12, 1989

[54] TOY FIREARM SHAPED LIKE A SIDEARM AND OPERATED BY MEANS OF A COMPRESSED-AIR SYSTEM FOR FIRING LIGHT-WEIGHT PROJECTILES

[76] Inventor: Giampiero Ferri, Via Vecchia Fiesolana No. 74, S. Domenico Fraz. Com. di Fiesole, Firenze, Italy

[21] Appl. No.: 203,237

[22] Filed: Jun. 6, 1988

[30] Foreign Application Priority Data

Jun. 11, 1987 [IT] Italy ..... 11666/87[U]

[51] Int. Cl.[4] ..... F41B 11/00

[52] U.S. Cl. ..... 42/54; 124/67

[58] Field of Search ..... 42/53, 54; 124/65, 66, 124/67; 446/473

[56] References Cited

U.S. PATENT DOCUMENTS

| | | | |
|---|---|---|---|
| 755,773 | 3/1904 | Hoerr | 42/53 |
| 1,268,205 | 6/1918 | Bet | 42/53 |
| 1,298,920 | 4/1919 | Farago | 42/53 |
| 2,922,412 | 1/1960 | Hosbach, Jr. | 124/67 |
| 3,341,964 | 9/1967 | Ryan et al. | 124/54 |
| 4,732,136 | 3/1988 | Ferri | 124/67 |

FOREIGN PATENT DOCUMENTS

| | | | |
|---|---|---|---|
| 5552 | of 1891 | United Kingdom | 42/53 |

*Primary Examiner*—Deborah L. Kyle
*Assistant Examiner*—Michael J. Carone
*Attorney, Agent, or Firm*—Hopgood, Calimafde, Kalil, Blaustein & Judlowe

[57] ABSTRACT

A toy firearm shaped like a sidearm—in particular a dagger—incorporating a compressed-air system for firing light-weight projectiles, that can be projected in accordance with the orientation of the blade, and wherein the compressed-air firing system is incorporated in the handle of the sidearm, and can be operated with the aid of a lateral control attachment originating at the movable part comprising both the cylinder and a perforated attachment for propelling the projectile and acting as an air vent.

3 Claims, 4 Drawing Sheets

TOY FIREARM SHAPED LIKE A SIDEARM AND OPERATED BY MEANS OF A COMPRESSED-AIR SYSTEM FOR FIRING LIGHT-WEIGHT PROJECTILES

The subject of the invention is a toy firearm shaped like a sidearm—in particular a dagger—incorporating a compressed-air system for firing light-weight projectiles, that can be projected in accordance with the orientation of the blade.

In practice, the compressed-air firing system is incorporated in the handle of the sidearm, and can be operated—by the loading of the spring acting on the compressed-air piston and positioning of the projectile to be fired—with the aid of a lateral control attachment originating at the movable part comprising both the cylinder and a perforated attachment for propelling the projectile and acting as an air vent, through a channel in the extension in limitation of the blade.

A resiliently urged retaining detent on the piston can be designed to act on an attachment originating at the piston rod and running along the side of the cylinder; the said retaining detent being actuated by a push-button.

The drawings illustrate a possible embodiment of the invention,as particularized below:

Figure 1:
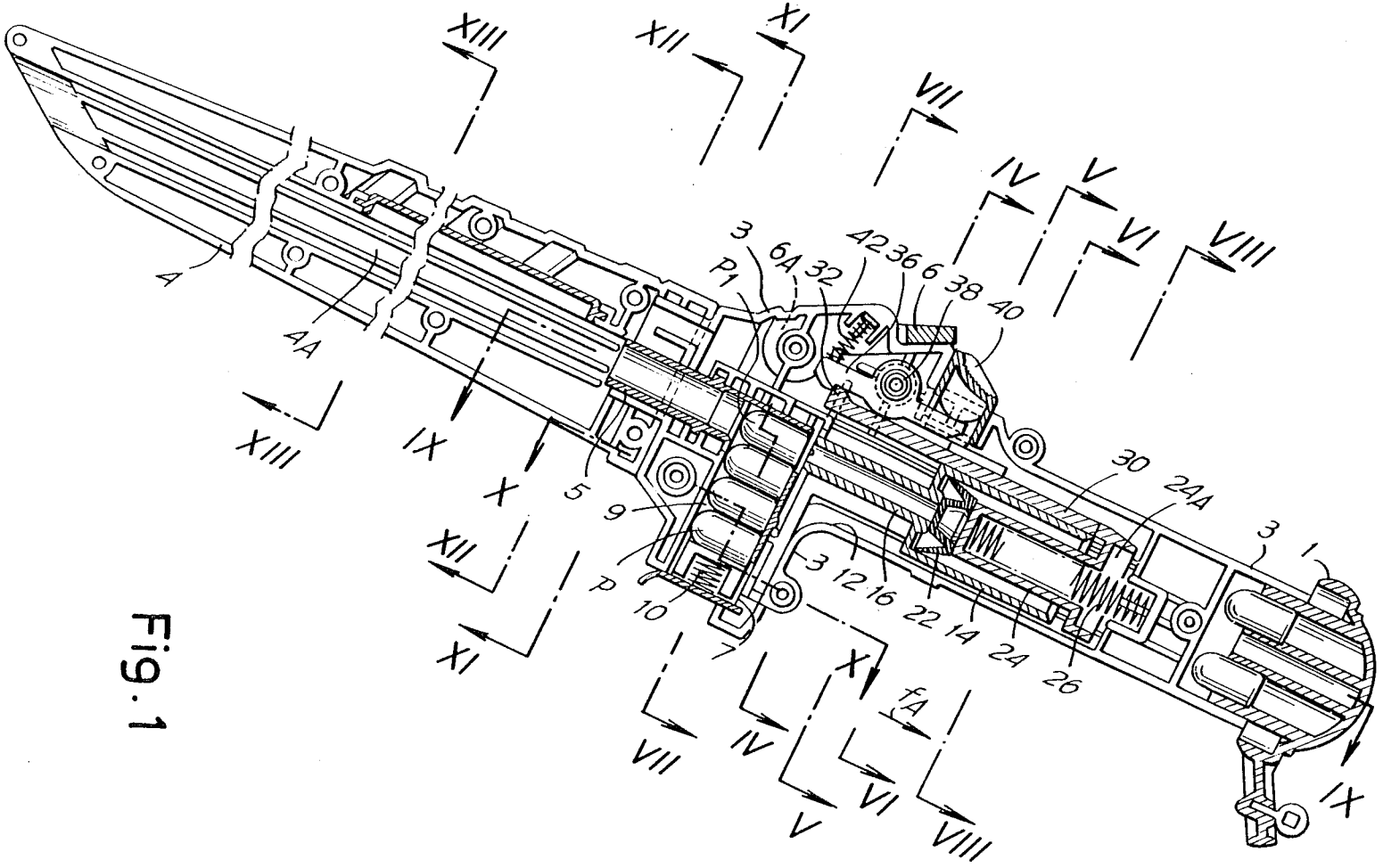
FIG. 1 represents a longitudinal sectional view of the handle of a toy firearm in the shape of a sidearm handle.

As illustrated in the attached drawings, 1 indicates a typical handle found with sidearms with a projection 3 comprising the socalled hilt adjacent to the handle. In addition to the projection 3, the firearm can exhibit a socket for inserting a blade, usually designed in the form of two housings 4, extending coaxially with and around a short barrel 5 projecting from the hilt and corresponding with a channel 4A formed by the blade. The hilt can in addition be fitted with a lever 6, hinged at 6A. The barrel 5 is preferred for enabling the projectiles P to be fired, which are contained in a loader 7 that can be placed inside a housing 9 in the projection 3 designed to accommodate the said loader 7. The projectiles P are urged inside the loader by means of a spring 10, in such a manner that the first of them P1 (the one seen to be on top in FIG. 1) is brought into alignment with the barrel 5. Inside the handle 1 is a slide housing 12 in which a cylinder 14 can slide, equipped with an axially perforated attachment 16 coaxial with the cylinder 14, the barrel 15 and so with the projectile P1 aligned with the barrel. The cylinder 14 can be controlled so as to effect reciprocating movements by means of a control attachment 18, projecting laterally from a slot 20 in the side of the handle (see FIG. 2). Inside the cylinder 14 a piston 22 can move with an axially perforated rod 24 for accommodating a spring 26 acting upon the bottom of the housing 12 in the handle; the rod 24 exhibits at its end not attached to the piston 22 a projection 24A from which an attachment 30 originates, parallel with and outside the cylinder 14 and with a detent 32 at its end; the attachment 30 and its detent 32 can slide in an internal groove 34 in the handle 1 and in the hilt projection 3. On the side of the attachment 30 and the detent 32 the hilt 3 also forms a housing for a resilient detent 36, which is hinged at 38 to the body 3 and can be actuated by the depression of a push-button 40 on the handle; the resilient detent 36 is urged by a spring 42 in the direction of the attachment 30 and can resiliently engage the detent 32 until it ceases to press on the pin 40.

Figure 2:
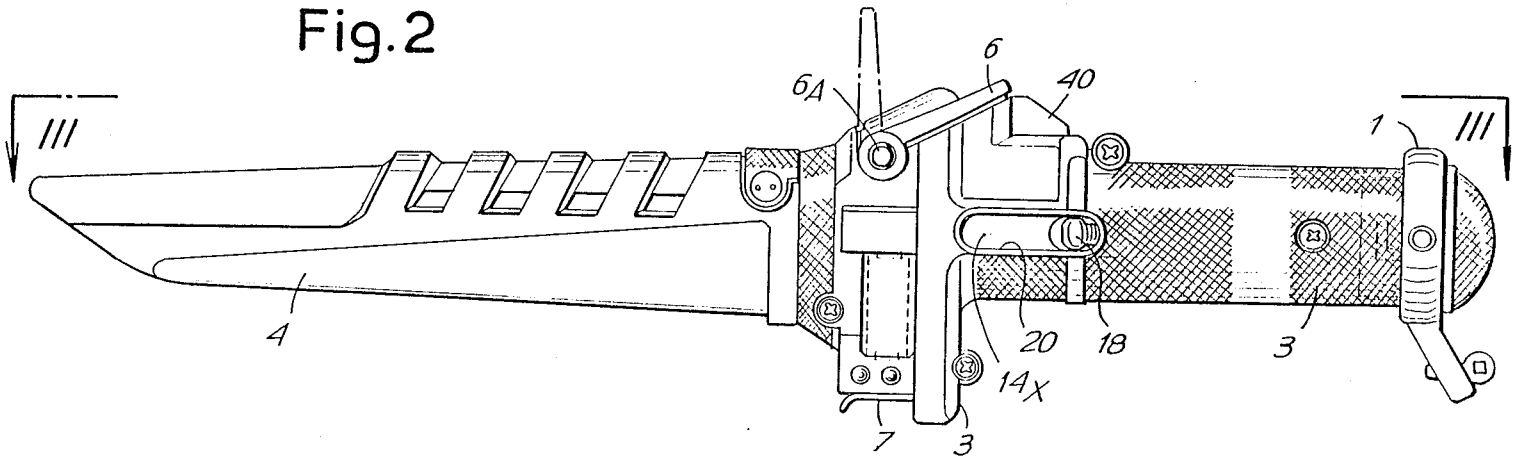
FIGS. 2 and 3 represent two external views of the firearm.
Figure 3:
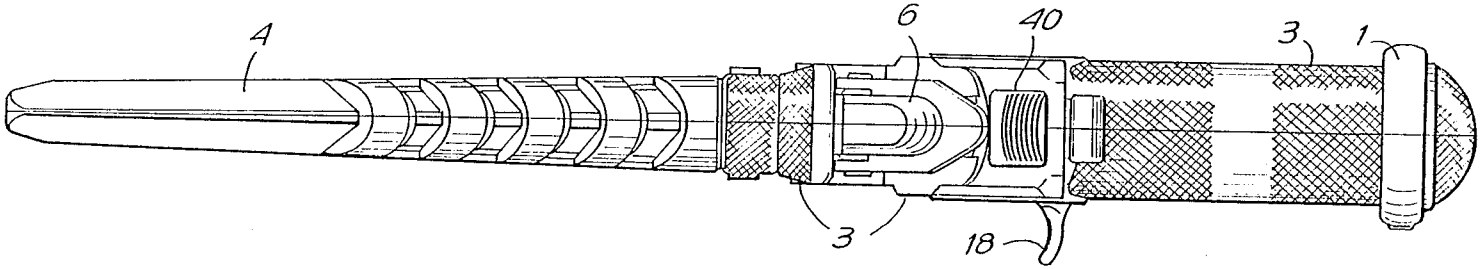
Figure 4:
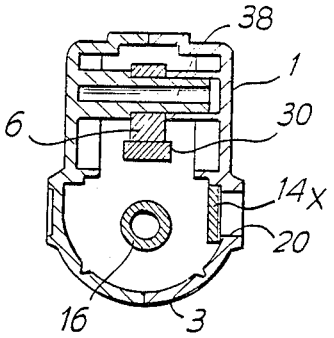
FIGS. 4 to 8 represent sections along IV—IV, V—V, VI—VI, VII—VII and VIII—VIII of FIG. 1.
Figure 5:
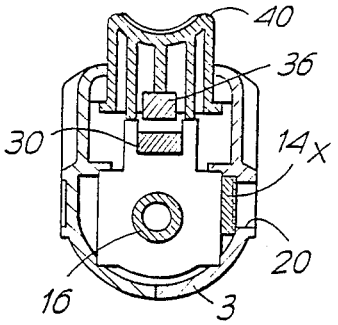
Figure 6:
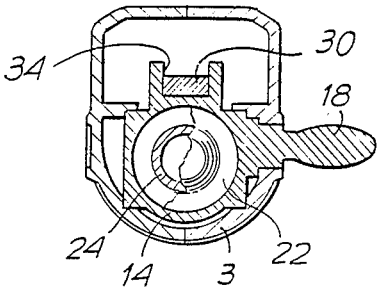
Figure 7:
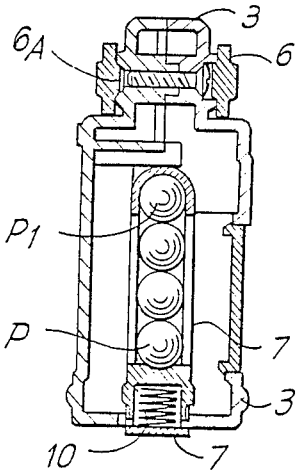
Figure 8:
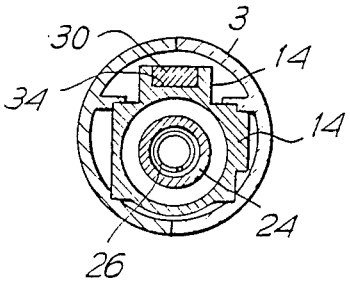
Figure 9:
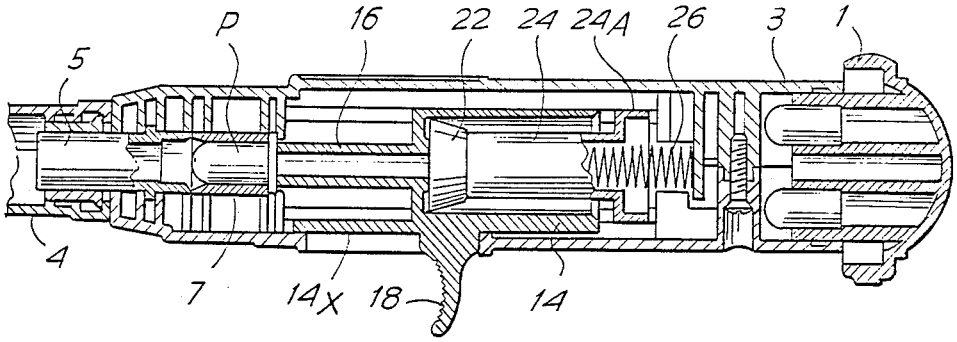
FIGS. 9 and 10 represent sections along IX—IX and X—X of FIG. 1.
Figure 10:
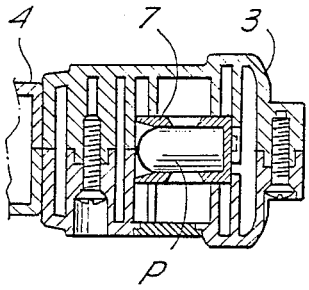
Figure 13:
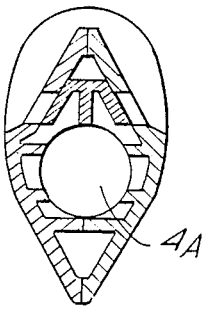
FIGS. 11 to 13 represent sections along XI—XI, XII—XII and XIII—XIII of FIG. 1.
Figure 12:
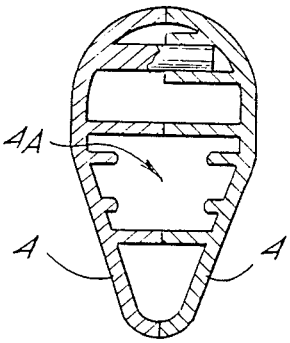
Figure 11:
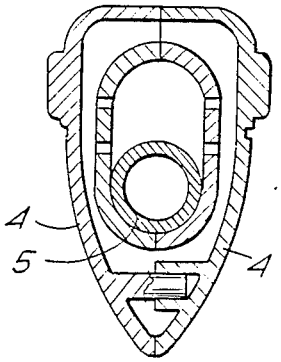

In the situation depicted in FIG. 1, the firearm is loaded, the spring 26 is loaded so as to urge the piston 22, which is however prevented from being released (by the action of the spring) by means of the resilient detent 36, which holds back the detent 32 upon which it is released in the loading stroke in accordance with the arrow fA. In these circumstances, the perforated attachment 16 of the cylinder 14 is in a retracted position in relation to the vertically positioned projectiles P, and one projectile P1 is brought into alignment with the barrel 5. The action of loading has been effected by means of a displacement of the lateral control attachment 18 in the direction of the arrow fA in order to load the spring; the cylinder 14, moving again from the position shown in FIGS. 1 and 2 in the inverse direction to that indicated by the arrow fA, together as before with the lateral control attachment 18 and the perforated attachment 16 of the cylinder 14, pushes the projectile P1 into the barrel 5 and follows on after it, in order to inhibit the vertically positioned projectiles P held in the loader 7, preventing them from many further movement by means of the spring 10. After the cylinder 14 has been moved in the inverse direction to that indicated by the arrow fA, an air cushion is created in the cylinder because the piston 22 is drawn back in relation to the cylinder that has been moved forward. At this point, depression of the pin 40 causes the resilient retaining detent 36 to lift off from the detent 32 with the result that the assembly formed by the piston 22, the rod 24 and the attachment 30 is propelled forcefully by the spring 26 in the inverse direction to that indicated by the arrow fA, thus causing pneumatic pressure inside the cylinder and hence pneumatic propulsion of the projectile P1 by the action of the compressed air escaping from the vent and travelling from the attachment 16 to make impact with the projectile P1 and fire it out of the barrel 5.

To repeat the cycle, the cylinder is moved again in the direction of the arrow fA, causing the attachment 16 to be drawn back and the displacement of a fresh projectile into position P1, and the piston 22 is again drawn back with compression of the spring 26 and retention of the piston assembly (against the action of the spring 26), in that the resilient detent 36 is retained on the detent 32 of the piston assembly. The whole of the mechanism resumes the position shown in FIG. 1, from which position the forward return of the cylinder can be actuated and hence the release of the compressedair system.

I claim:

1. A toy firearm shaped like a dagger having a blade and having a handle for firing light-weight projectiles, that can be projected in accordance with the orientation of the blade, comprising a short barrel projecting from the handle into the blade, and through which the projectiles are fired, a slide housing inside the handle said slide housing having a cylinder which can slide therein, said cylinder equipped with an axially perforated attachment coaxial with the cylinder and with the barrel and with a projectile aligned with the barrel;

a control attachment for controlling the cylinder so as to effect reciprocating movements of the cylinder, and said control attachment projecting laterally from a slot in the side of the handle;

a piston inside the cylinder said piston moved by an axially perforated rod for accommodating a spring therein, which spring acts upon the bottom of the slide housing in the handle; said rod having a projection at its end not attached to the piston, an attachment originating at said projection parallel with and outside the cylinder and having a detent at its end; the attachment and said detent sliding in an internal groove in the handle;

a resilient detent which is hinged to the handle and a push button for actuating the resilient detent, said push button being on the handle; said resilient detent being urged by a spring in the direction of the atatchment so as to resiliently engage the detent on the attachment, whereby depressing of the push button counteracts the spring force holding the resilient detent in contact with the detent of the attachment, so as to permit the spring of the piston to freely expand and to move the piston toward the perforated attachment, the barrel and a projectile therein, such that the air of the cylinder becomes compressed and propels said projectile out of the barrel and through the blade.

2. The toy firearm of claim 1, further comprising a loader for containing the projectiles to be propelled out through the blade, said loader being positioned in said handle between said barrel and said cylinder containing said piston.

3. The toy firearm of claim 1, further comprising a safety-catch formed with a double projection under the push button which comprises a cylinder on the two sides of the extension; this projection preventing the manuvering of the push button and therefore the firing until the cylinder with the perforated attachment has been moved.

* * * * *